US005111951A

United States Patent [19]

Breen et al.

[11] Patent Number: 5,111,951

[45] Date of Patent: May 12, 1992

[54] SUPPLEMENTAL WASTE RECYCLING CONTAINER FOR MOUNTING TO A WASTEBASKET

[75] Inventors: John D. Breen, Wooster; Thomas Scherer, Mansfield, both of Ohio

[73] Assignee: Rubbermaid Office Products Group, Inc., Inglewood, Calif.

[21] Appl. No.: 792,142

[22] Filed: Nov. 12, 1991

[51] Int. Cl.[5] ..... A47G 19/00; B65D 21/02

[52] U.S. Cl. ..... 220/23.4; 220/729; 220/909

[58] Field of Search ..... 220/23.4, 23.83, 528, 220/729, 909

[56] References Cited

U.S. PATENT DOCUMENTS

| | | | |
|---|---|---|---|
| 768,364 | 8/1904 | Hines | 220/23.4 |
| 774,763 | 11/1904 | Levey . | |
| 992,006 | 5/1911 | Kubersky et al. . | |
| 1,613,671 | 1/1927 | O'Donnell . | |
| 2,736,454 | 2/1956 | McConnell . | |
| 3,047,185 | 7/1962 | Lewis | 220/23.4 X |
| 3,343,706 | 9/1967 | Berend | 220/23.4 |
| 3,384,260 | 5/1968 | Buffington . | |
| 3,442,435 | 5/1969 | Ludder et al. . | |
| 3,526,334 | 9/1970 | Ashton et al. . | |
| 3,589,554 | 6/1971 | Smith . | |
| 3,720,346 | 3/1973 | Cypher . | |
| 3,856,173 | 12/1974 | Deane et al. . | |
| 3,893,615 | 7/1975 | Johnson . | |
| 3,904,218 | 9/1975 | Kostic . | |
| 4,024,590 | 5/1977 | Wendt . | |
| 4,114,776 | 9/1978 | Pluss . | |
| 4,161,252 | 7/1979 | Howells . | |
| 4,475,660 | 10/1984 | Cain . | |
| 4,646,628 | 3/1987 | Lederman . | |
| 4,739,894 | 4/1988 | Pender . | |
| 4,834,253 | 5/1989 | Crine . | |
| 4,834,262 | 5/1989 | Reed . | |
| 4,854,466 | 8/1989 | Lane, Jr. | 220/23.83 |
| 4,867,328 | 9/1989 | McCarthy . | |
| 4,893,719 | 1/1990 | Lombardi et al. . | |
| 4,919,268 | 4/1990 | Young et al. | 206/509 |
| 4,940,159 | 7/1990 | Callas et al. . | |
| 4,978,023 | 12/1990 | Behlmann et al. . | |
| 5,033,641 | 7/1991 | Martin . | |

FOREIGN PATENT DOCUMENTS

| | | |
|---|---|---|
| 3524781 | 1/1987 | Fed. Rep. of Germany . |
| 2565812 | 6/1984 | France . |
| 2182641 | 5/1987 | United Kingdom . |

*Primary Examiner*—Stephen Marcus
*Assistant Examiner*—Nova Stucker
*Attorney, Agent, or Firm*—Price, Gess & Ubell

[57] ABSTRACT

A supplemental waste recycling container for mounting to either the inside or outside of a larger waste container is provided. The supplemental container includes an out-turned rim extending around the circumference of its upper edge. The container also includes two parallel horizontally-extending mounting members extending outwardly from the upper edge of the supplemental container. The out-turned rim is profiled to mount to either the inside or outside of the larger waste container. The horizontally-extending mounting members include depending lateral flanges for mounting along sides of the large waste container when the supplemental container is either mounted to the inside or the outside of the larger container. The horizontally-extending mounting members, together in combination with the profile of the out-turned rim, thus allow the supplemental container to be easily and securely mounted either to the inside or outside of a larger waste container, without requiring hooks, clasps, or other mounting devices. The supplemental container is thus ideally suited for use by a consumer in the recycling of refuse.

19 Claims, 4 Drawing Sheets

SUPPLEMENTAL WASTE RECYCLING CONTAINER FOR MOUNTING TO A WASTEBASKET

BACKGROUND OF THE INVENTION

1. Field of the Invention

The invention set forth in the specification pertains to a supplemental waste recycling container for mounting to a wastebasket. More specifically, the invention pertains to a supplemental recycling container for mounting to either the inside or outside of the wastebasket without requiring special mounting means such as hooks or clasps.

2. Description of Related Art

Various container systems have been disclosed in the prior art which provide multiple-compartment refuse containers to allow a consumer to separate refuse for the purpose of recycling portions of the refuse.

Typical multiple compartment containers include those disclosed in Crine U.S. Pat. No. 4,834,253, Kostic U.S. Pat. No. 3,904,218, Pender U.S. Pat. No. 4,739,894, Johnson U.S. Pat. No. 3,893,615 and Pluss U.S Pat. No. 4,114,776.

The Crine patent provides a recycling container unit having relatively small waste containers mounted to the inside of a larger vessel. The inner containers are detachably mounted via an anchoring means comprising interlocking male and female slot structures.

The Kostic patent provides a complementary trash can unit comprising four quarter-sectional cylindrical compartments mounted together to form a single circular cylindrical container for receiving trash. A lid and a base are provided for securing the four compartments together as one unit.

The Pender patent provides a supplemental container assembly for garbage including four generally semicircular compartments. Two of the compartments are mounted together to form a circular cylindrical bottom section. The remaining two sections are mounted together to form a second circular cylindrical section and are positioned on top of the lower cylindrical section but rotated by 90 degrees with respect to the bottom section. The upper cylindrical sections include interior recessed walls which mate to provide shoots to the lower containers.

The Johnson patent provides a multiple compartment refuse container having a cabinet-type bin providing a linear array of individual waste receptacles, each having an upper door and a side door.

The Pluss patent likewise discloses a recycling container providing a linear array of individual sections for recycling waste.

Multiple-compartment recycling containers such as those discussed above are typically expensive to manufacture, cumbersome to use, and require considerable space.

Simpler and less expensive waste recycling containers have also been disclosed for use with existing waste containers. Such containers are typically mounted either to the interior or exterior of a larger waste container. Typically, such containers are mounted by means of hooks or clasps. However, the need for such hook or clasp mounting means is disadvantageous since the hooks or clasps add to the cost of the container and often do not securely fasten the waste recycling container to the larger waste container. Furthermore, such hook or clasp means can be lost or broken, in which event the waste recycling container can no longer be mounted to the larger receptacle.

Yet other waste recycling containers have been disclosed wherein a supplemental container rests on the interior rim of a larger waste container. Such containers are not securely mounted to the rim of the larger container. Thus, the supplemental container can be easily dislodged from the larger container and fall into the larger container where it may be discarded accidentally. To solve the problem, the recycling container is often made oversize with respect to the interior of the larger waste container such that the supplemental container is wedged into the larger container. Such supplemental containers are often very difficult to insert or remove and can damage the larger container upon insertion or removal.

SUMMARY OF THE INVENTION

It is believed that it will be apparent from the preceding that there is a need for a new and improved supplemental waste recycling container adapted for securely mounting to either the inside or outside of a commercial wastebasket without requiring any hooks, clasps, or other special mounting means. Broadly, the invention is intended to provide a supplemental waste recycling container meeting or fulfilling this need.

Therefore, an object of the invention is to provide a supplemental waste recycling container adapted for mounting to the interior or exterior of a commercial wastebasket.

Another object of the invention is to provide a supplemental waste recycling container which can be mounted to a commercial wastebasket without requiring hooks, clasps, or other mounting means.

Yet another object of the invention is to provide a supplemental waste recycling container which can be securely mounted to a commercial wastebasket and yet easily removed from the wastebasket.

Yet another object of the invention is to provide a supplemental waste recycling container which can be easily and inexpensively manufactured.

Yet another object of the invention is to provide a supplemental waste recycling container which can be simply manufactured from inexpensive materials such as plastic.

Yet another object of the invention is to provide a supplemental waste recycling container which, when mounted to a commercial wastebasket, takes up a minimum of additional space.

These broad objections of the invention are achieved by providing a supplemental waste recycling container for mounting to, and depending from, the top rim of a wastebasket, with the supplemental container being adapted for mounting to either an inside or outside surface of the wastebasket. The supplemental container includes an upper out-turned rim with mounting members extending therefrom. The out-turned rim and the mounting members together comprise first and second mounting sections, each shaped complementarily with an end portion of an upper rim of the wastebasket for engaging with, and mounting securely over, the end portion of the upper rim of the wastebasket. The first mounting section is adapted for mounting the supplemental container to the outside surface of the wastebasket, and the second mounting section is adapted for mounting the supplemental container to the inside surface of the wastebasket.

In accordance with a preferred embodiment of the invention, a supplemental waste container is provided having: first and second opposing side walls, each wall having an upper out-turned rim; first and second opposing end walls; and two generally horizontal mounting members extending outwardly from opposite top corners of the first side wall of the receptacle. The horizontal members are substantially parallel to the end walls of the supplemental container, and each extending horizontal member includes parallel flanges depending from opposing sides of the members.

Also in accordance with the preferred embodiment, the first and second side walls of the supplemental container are complementarily shaped with an outside surface of the end wall of the wastebasket for juxtaposition therewith.

The supplemental waste recycling container just summarized is ideally adapted for mounting to either the inside or outside of a commercial wastebasket. To mount to the outside of a wastebasket, the out-turned rim of the first side of the supplemental container is securely fastened over an upper out-turned rim of the end wall of the wastebasket, and the horizontally-extending mounting members are securely fitted over an upper out-turned rim extending along the side walls of the wastebasket. To mount the supplemental container to the inside of a wastebasket, the out-turned rim on the second side surface of the supplemental container is securely fitted over the out-turned rim of the end wall of the wastebasket, and the horizontal mounting members are securely fitted over the side walls of the wastebasket at positions set back from the end of the wastebasket.

BRIEF DESCRIPTION OF THE DRAWINGS

The objects and features of the present invention, which are believed to be novel, are set forth with particularity in the appended claims. The present invention, both as to its organization and manner of operation, together with further objects and advantages, may best be understood by reference to the following description, taken in connection with the accompanying drawings.

DESCRIPTION OF THE PREFERRED EMBODIMENTS

The following description is provided to enable any person skilled in the art to make and use the invention and sets forth the best modes contemplated by the inventor of carrying out his invention. Various modifications, however, will remain readily apparent to those skilled in the art, since the generic principles of the present invention have been defined herein specifically to provide a supplemental waste recycling container for mounting to either the inside or outside of a wastebasket.

Figure 1:
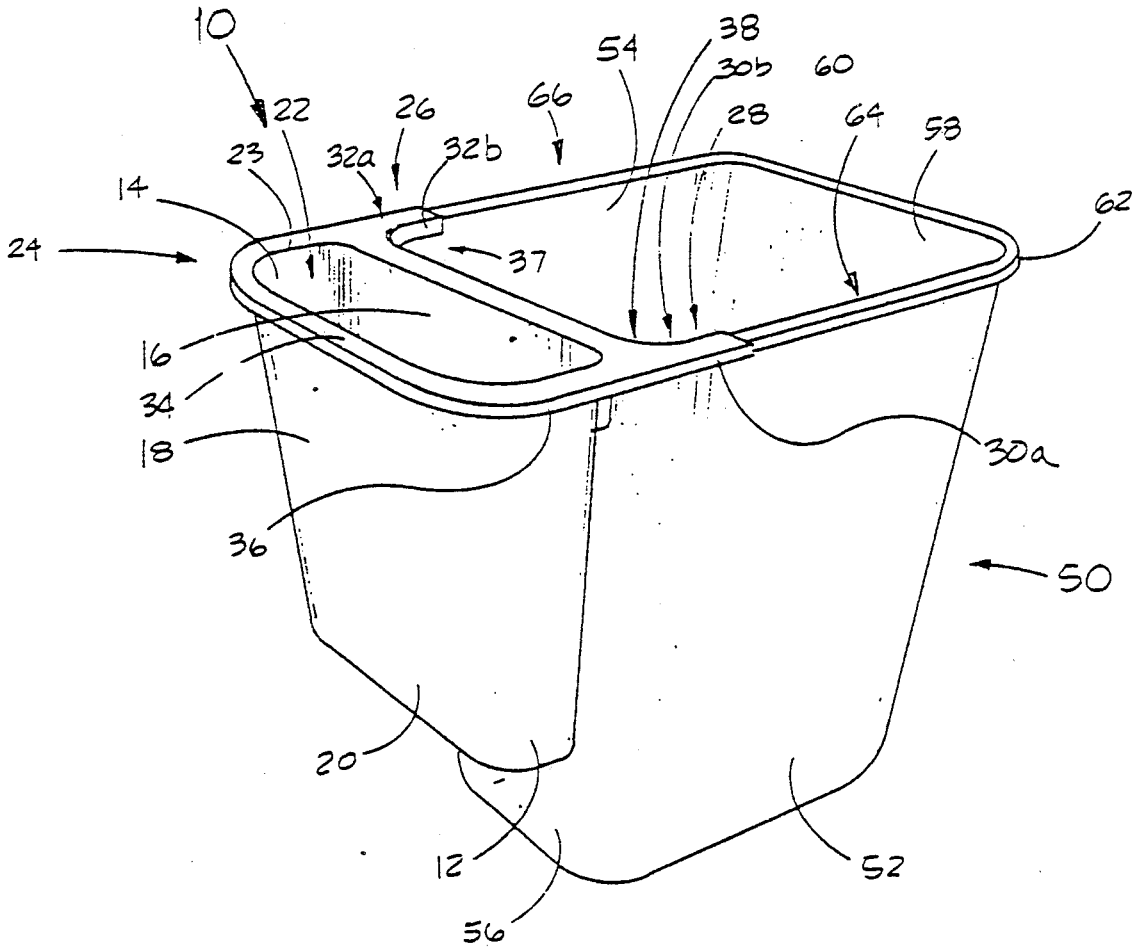
FIG. 1 is a perspective view of a supplemental waste recycling container constructed in accordance with a preferred embodiment of the invention with the container, mounted to the outside of a wastebasket.
Figure 2:
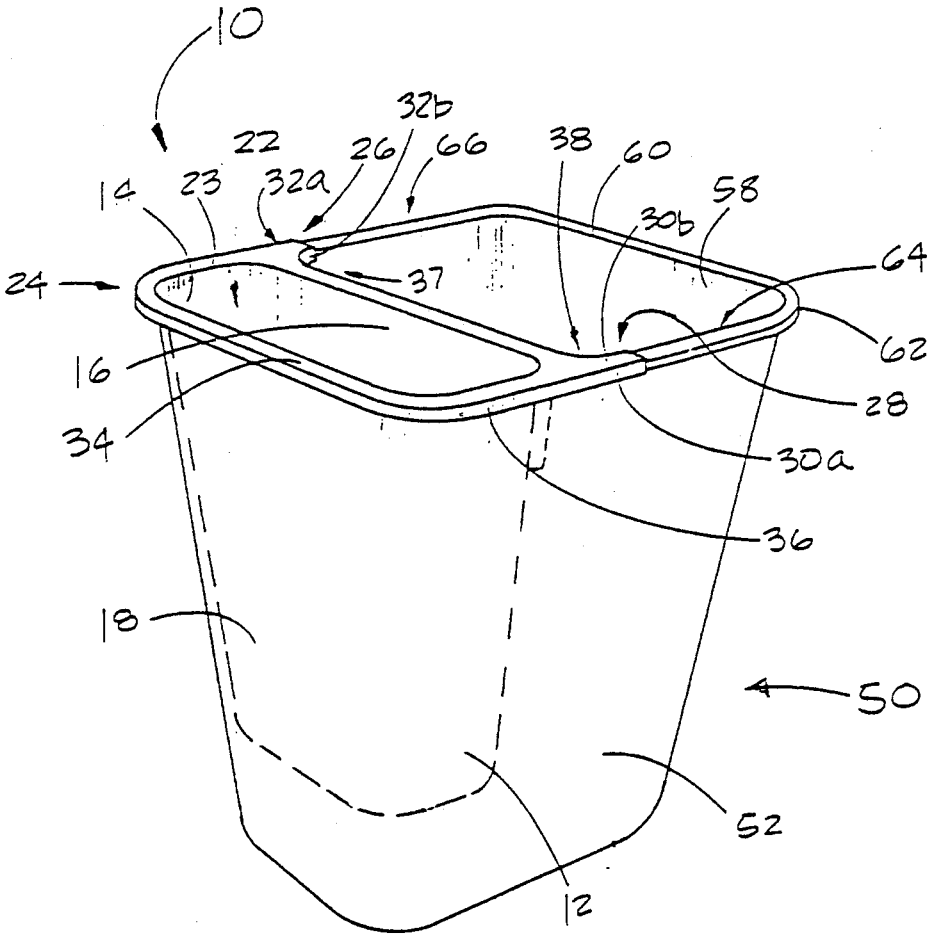
FIG. 2 is a perspective view of the supplemental container of FIG. 1 shown mounted to the inside of a wastebasket.

In each of the six figures of the drawings, a supplemental waste recycling supplemental container 10 is shown. The invention will be described primarily with reference to FIGS. 1 and 2, with FIGS. 3 through 6 providing, for clarity, additional views of supplemental container 10. In FIG. 1, supplemental container 10 is shown mounted to the outside of a wastebasket 50. In FIG. 2, supplemental container 10 is shown mounted to the inside of wastebasket 50.

Supplemental container 10 includes first and second opposing end walls, designated 12 and 14, respectively, and first and second side walls, designated 16 and 18, respectively, and a bottom section, 20. Together, side walls 16 and 18, end walls 12 and 14, and bottom section 20 form a basket for containing trash, waste, refuse, garbage, and the like.

Supplemental container 10 includes an upper opening or mouth 22 bounded by an upper edge 23. An out-turned rim or flange 24 is provided around the circumference of rim 23 of supplemental container 10.

Supplemental container 10 further includes mounting members 26 and 28 which extend horizontally outwardly from edge 23 of supplemental container 10. Mounting members 26 and 28 are parallel to each other and parallel to end walls 12 and 14. Mounting members 26 and 28 extend outwardly from upper right and left corners, respectively, of side wall 16 and, together with edge 23, form a generally planar upper surface.

Generally, out-turned rim 24 along side wall 16, together with mounting members 26 and 28, comprise a first mounting section for mounting container 10 to the outside of a wastebasket (FIG. 1). Out-turned rim 24 along side wall 18, together with mounting members 26 and 28, comprise a second mounting section for mounting container 10 to the inside of a wastebasket (FIG. 2).

Mounting member 26 further includes lateral depending flanges **32*a* and 32*b*. Flange 32*a* extends along the outer length of mounting member 26 and forms an extension of out-turned rim 24 adjacent to end wall 14**.

Depending flange **32*b* extends along the inner length of mounting member 26 and forms an extension of out-turned rim 24 adjacent to side wall 16**.

Mounting member 28 includes similar depending flanges **30*a* and 30*b* which extend laterally along the outside and inside edges, respectively, of mounting member 28 and form extensions of out-turned rim 24 adjacent to side wall 16 and end wall 12**, respectively.

Figure 5:
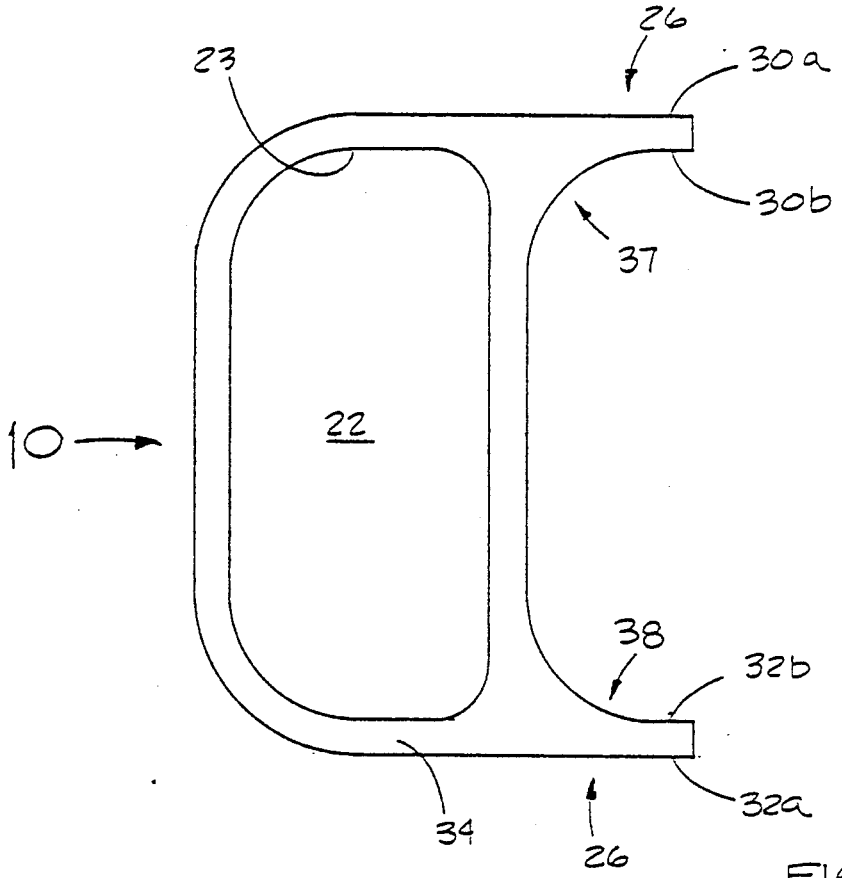
FIG. 5 is a top elevational view of the supplemental waste recycling container of FIG. 1.

As can best be seen from FIG. 5, upper edge 23 and mounting members 26 and 28 together form a generally A-shaped upper frame for supplemental container 10.

Figure 6:
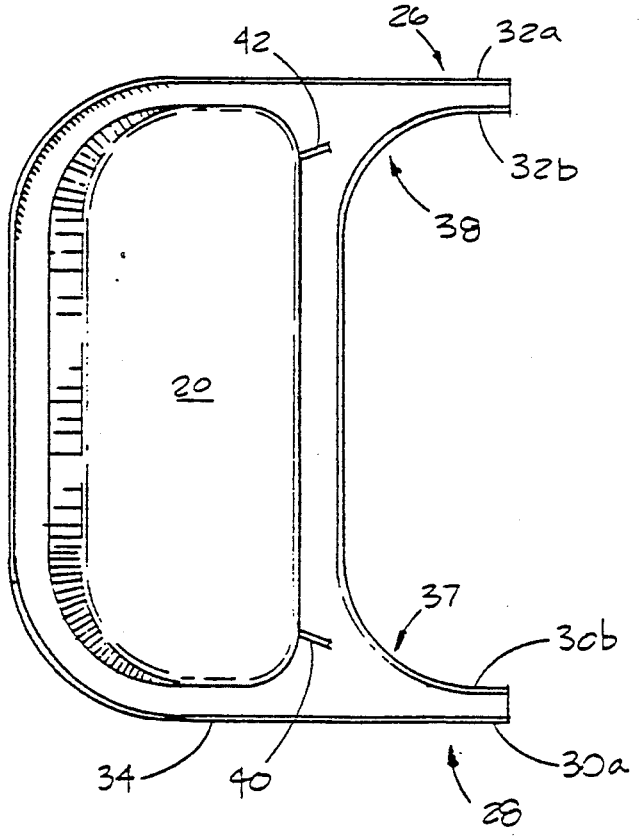
FIG. 6 is a bottom elevational view of the supplemental waste recycling container of FIG. 1.

As can be seen most clearly from FIG. 6, upper out-turned rim 24 and depending flanges **32*a*, 32*b*, and 30*a*, 30*b*, together form a continuous depending rim or flange extending around the circumference of upper edge 23 and extending outwardly along the inside and outside edges of mounting members 26 and 28. Depending flanges 32*a*, 32*b* and 30*a*, 30*b* extend only to the end of mounting members 26 and 28, respectively, leaving the ends of mounting members 26 and 28** open. Thus the depending flanges extend parallel along the length of the mounting members, but do not connect at the end of the mounting members.

Figure 3:
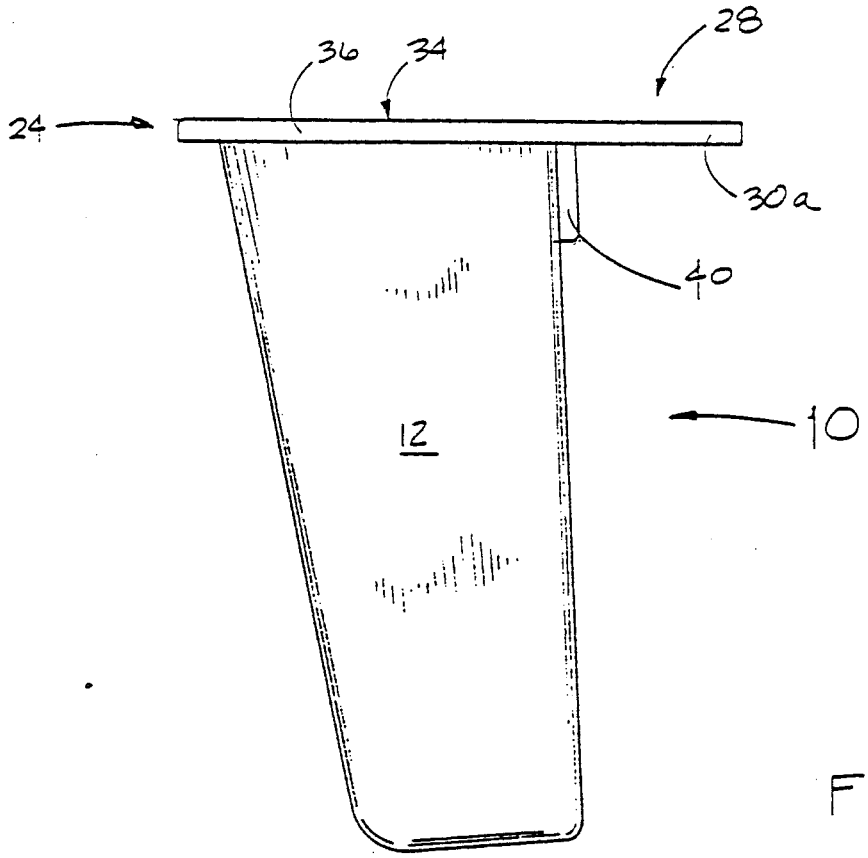
FIG. 3 is a side elevational view of the supplemental waste recycling container of FIG. 1.

As can be seen most clearly from FIG. 3, side wall 16 of supplemental container 10 forms a generally planar rectangular surface.

As can be seen most clearly from FIGS. 5 and 6, end walls 12 and 14 and side wall 18 are connected by vertical edges having a generally arcuate horizontal cross-section. Out-turned rim 24 is likewise arcuate along end walls 12 and 14 and side wall 16.

Figure 4:
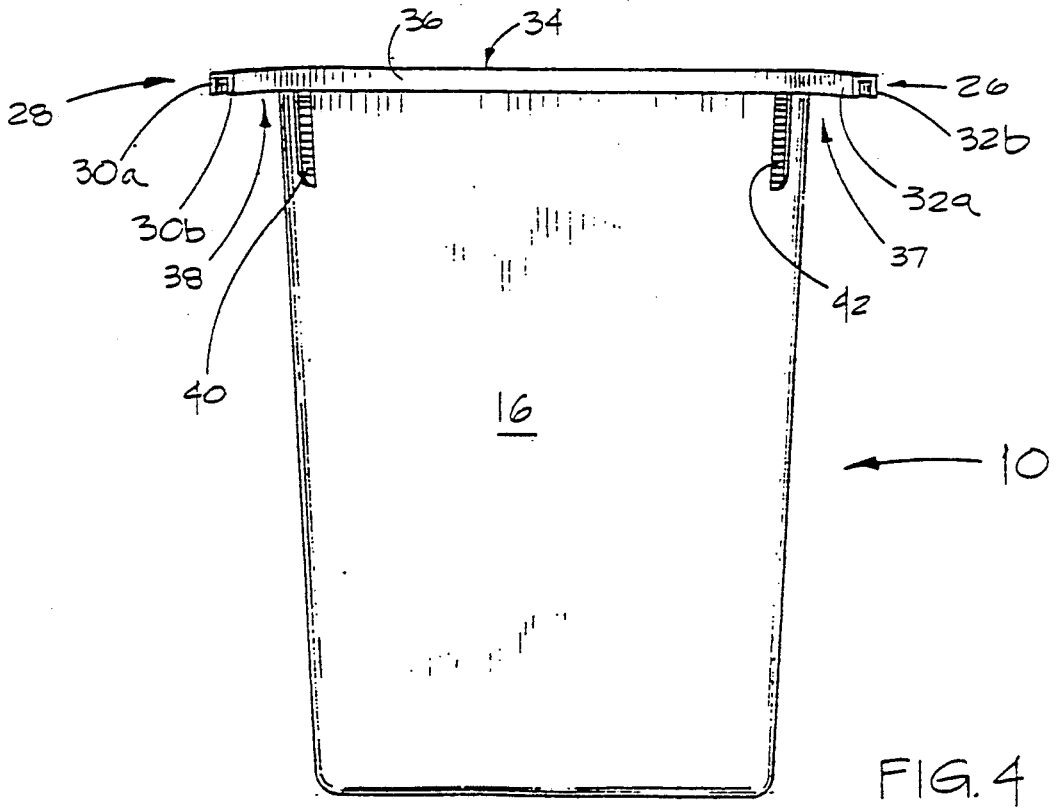
FIG. 4 is a front elevational view of the supplemental waste recycling container of FIG. 1.

As shown in FIGS. 3, 4, and 6, a pair of vertical flanges 42 and 44 are provided below mounting members 28 and 26, respectively, to allow for easy handling during manufacture.

Considering out-turned rim 24 in more detail, out-turned rim 24 includes a flat upper edge 34 and a depending flange 36. Upper edge 34 extends perpendicularly outward from the upper edges of end walls 12 and 14 and side walls 16 and 18. Depending flange 36 extends perpendicularly downward from upper edge 34 such that depending flange 36 is parallel with end walls 12 and 14 and side walls 16 and 18.

Mounting members 26 and 28 likewise define upper horizontal surfaces bounded by perpendicularly depending flanges.

Upper edge 34 extends an equal distance outward from the top edges of side walls 16 and 18 and end walls 12 and 14 along substantially the entire circumference thereof. However, along the top of side wall 16, out-turned rim 24 has a generally arcuate profile. That is, out-turned rim 24 includes curved portions 37 and 38 adjacent to the inside edges of mounting members 26 and 28, respectively. In this manner, out-turned rim 24 includes a curved profile along side surface 16 which matches the curved profile of out-turned rim 24 along side surface 18. The resulting profile of out-turned rim 24, in combination with flanges depending from mounting rims 26 and 28, allows supplemental container 10 to be mounted either to the inside or outside surfaces of a larger wastebasket 50, as shown in FIGS. 1 and 2

Wastebasket 50 is preferably a standard commercially-available waste container. Wastebasket 50 includes generally parallel planar side walls 52 and 54, and generally planar end walls 56 and 58. Wastebasket 50 includes an upper edge 60, including an out-turned rim 62 extending circumferentially around rim 60. The side walls and end walls of wastebasket 50 together form curved edges as shown. Thus, upper rim 60 of wastebasket 50 includes generally arcuate corner portions.

The arcuate profile of rim 24 of supplemental container 10 along side wall 18 is chosen to match perfectly with the arcuate profile of rim 60 of wastebasket 50 along end wall 56. Likewise, the arcuate profile formed by out-turned rim 24 and interior side flanges 32*b* and 30*b* of supplemental container 10 is chosen to match perfectly with the arcuate rim 60 of wastebasket 50 along side wall 56. By matching the profile of rim 24 along side wall 18 with the profile of rim 60 along end wall 56, supplemental container 10 is mountable to the interior surface of wastebasket 50, as shown in FIG. 2. Likewise, by matching the profile of rim 24 and depending flanges 30*b* and 32*b* along side wall 18 with the profile of rim 60 of wastebasket 50 along end wall 56, supplemental container 10 is mountable to the outside surface of wastebasket 50, as shown in FIG. 1

When mounted to wastebasket 60, mounting members 26 and 28 extend along upper edges 64 and 66 of side walls 52 and 54, respectively. The depending flanges 30*a*, 30*b* and 32*a*, 32*b* of mounting members 28 and 26, respectively, securely mount to inner and outer surfaces of out-turned rim 62 of wastebasket 60 as shown.

First considering supplemental container 10 mounted to the outside of wastebasket 50 as shown in FIG. 1, side wall 16 of supplemental container 10 is juxtaposed against the outer surface of end wall 56 of wastebasket 50. Out-turned rim 24, along the upper edge of side wall 16, mounts over out-turned rim 62 of wastebasket 50 along the upper edge of end wall 56. Mounting members 26 and 28 extend along the upper edges of side walls 52 and 54 of wastebasket 60 and, as noted above, mount securely over out-turned rim 62 of wastebasket 50. In this manner, supplemental container 10 is securely but detachably mounted to the outside of wastebasket 50. This is accomplished without the need for any special mounting means such as hooks or clasps.

Next considering supplemental container 10 mounted to the interior of wastebasket 50, as shown in FIG. 2, side wall 18 and end walls 12 and 14 of supplemental container 10 are juxtaposed against the interior of end wall 56 of wastebasket 50. Out-turned rim 24 of supplemental container 10 is mounted securely over out-turned rim 62 of wastebasket 50. Out-turned rim 24 of side walls 12 and 14 mounts securely over out-turned rim 64 of side walls 52 and 54 of wastebasket 50. Mounting members 26 and 28 likewise mount securely over out-turned rim 62 of side walls 52 and 54 of wastebasket 50. In this manner, supplemental container 10 is detachably but securely mounted to the interior of wastebasket 50.

In use, in either configuration, supplemental container 10 provides a secondary container to allow for convenient separation of waste for the purposes of recycling. Thus, for example, aluminum cans can be deposited within supplemental container 10, whereas other refuse can be deposited within wastebasket 50. When mounted to the outside surface of wastebasket 50, a maximum amount of waste storage space is available. However, in circumstances where space is limited, supplemental container 10 can be advantageously mounted to the interior surface of wastebasket 50 such that no additional space is needed.

Although not shown in the figures, two containers 10 can be simultaneously mounted to wastebasket 50. A first container can be mounted on one end of wastebasket 50 while a the second container is mounted on the opposing end of wastebasket 50. Either container or both containers can be mounted to the inside or outside surfaces of wastebasket 50.

Preferably, as shown most clearly in FIG. 3, upper rim 24 and mounting members 26 and 28 of FIG. 10 are mounted in a plane which is angled with respect to the side and end walls of supplemental container 10. In this manner, supplemental container 10 matches the inwardly-angled outer surfaces of wastebasket 50 for more secure mounting.

Also preferably, supplemental container 10 is formed entirely from a durable plastic material.

The container as shown is particularly adapted for use with a standard commercial plastic waste paper container such as Rubbermaid Product No. 2956 available from Rubbermaid Inc., Wooster, Ohio. However, as will be understood by those skilled in the art, supplemental container 10 can be dimensioned and shaped to work with any suitable waste container having generally parallel side walls. Thus, for example, although not shown in the drawings, a supplemental container 10 can be dimensioned to mount to a generally oval-shaped waste container. In such case, side walls 16 and 18 of supplemental container 10 would preferably have arcuate shapes matching the curved end portions of the oval waste container.

Also, although the drawings show out-turned rim 24 extending along the entire circumference of upper edge 23 of supplemental container 10, rather, it is only necessary that out-turned rim 24 extend along suitable portions of supplemental container 10 for mounting to wastebasket 60. For example, it would be sufficient for out-turned rim 24 to extend only along top corners of supplemental container 10. Such a rim configuration, in combination with the depending flanges of mounting members 26 and 28, would be sufficient to securely mount supplemental container 10 to either the inside or outside of wastebasket 50.

Those skilled in the art will appreciate that various other adaptations and modifications of the just-described preferred embodiment can be configured without departing from the scope and spirit of the invention. Therefore, it is to be understood that, within the scope of the appended claims, the invention may be practiced other than as specifically described herein.

What is claimed is:

1. A supplemental waste container for mounting to, and depending from, a top rim of a wastebasket, the supplemental container being adapted for depending from either an inside or an outside surface of the wastebasket, said supplemental container having an upper out-turned rim with mounting members extending therefrom, said out-turned rim and said mounting members together comprising first and second mounting sections each shaped complementarily with an end portion of the upper rim of the wastebasket for engaging with, and mounting securely over, said end portion of the upper rim of the wastebasket, with said first mounting section adapted for mounting the supplemental container to the outside surface of the wastebasket and said second mounting section adapted for mounting the supplemental container to the inside surface of the wastebasket.

2. A supplemental waste container for mounting to either the inside or outside of a wastebasket to facilitate the recycling of waste, said supplemental container comprising:

first and second opposing side walls, each having an out-turned rim;

first and second opposing end walls connecting the side walls;

two mounting members extending outwardly from opposite top corners of the first side wall of the supplemental container, said members being substantially perpendicular to the first side wall of the supplemental container; each extending member having parallel flanges depending from opposing sides of the members.

3. The supplemental waste container of claim 2, wherein said end walls of said supplemental container are substantially parallel.

4. The supplemental waste container of claim 2, wherein said side walls of said supplemental container are substantially parallel.

5. The supplemental waste container of claim 2, wherein edges connecting said end walls of said supplemental container to said second side wall have arcuate cross-sections.

6. The supplemental waste container of claim 2, wherein said end walls of said supplemental container are substantially planar.

7. The supplemental waste container of claim 2, wherein said side walls of said supplemental container are substantially planar.

8. The supplemental waste container of claim 2, wherein said supplemental container is formed of a molded plastic.

9. The supplemental waste container of claim 2, wherein a top rim of the supplemental waste container and the first and second members form a plane perpendicular to the side and end walls of the supplemental container.

10. The supplemental waste container of claim 2, wherein a top rim of the supplemental waste container and the first and second members form a plane angled with respect to the side and end walls of the supplemental container.

11. A supplemental waste container for mounting to, and depending from, a rim of a wastebasket, the wastebasket having side walls and, at least, one end wall connecting the side walls, the supplemental container being adapted for mounting to either inside or outside surfaces of the wastebasket along the end wall, said supplemental container comprising:

first and second opposing side walls; first and second opposing end walls connecting the side walls, the side walls having a width substantially equal to an interior width of the end wall of the wastebasket; first and second mounting members extending horizontally outwardly from opposite top corners of the first side wall of the supplemental container perpendicular to the first side walls of the supplemental container;

the first side wall being complementarily shaped with an outside surface of the end wall of the wastebasket for juxtaposition therewith when said supplemental container is mounted to said outside of said wastebasket; an out-turned rim being formed along a top edge of the first side wall for mounting over the rim of the wastebasket along the end wall of the wastebasket; each extending member having depending flanges for mounting over a portion of the rim of the side walls of the wastebasket;

the second side wall being complementarily shaped with the inside surface of the end wall of the wastebasket for juxtaposition therewith when said supplemental container is mounted to said inside of said wastebasket; an out-turned rim being formed along a top edge of the second side wall of the supplemental container for mounting over the rim of the end wall of the wastebasket; the extending members mounting to a portion of the top rim of the side walls of the wastebasket.

12. The supplemental waste container of claim 11, wherein said end walls of said supplemental container are substantially parallel and the side walls of the wastebasket are substantially parallel.

13. The supplemental waste container of claim 11, wherein edges connecting said end walls of said supplemental container to said second side wall have arcuate cross-sections.

14. The supplemental waste container of claim 11, wherein said side walls of said supplemental container are substantially planar.

15. The supplemental waste container of claim 11, wherein the ends walls of the supplemental container have an upper out-turned rim contiguous with the upper out-turned rim of the second side wall and contiguous with outer depending flanges of the first and second members.

16. The supplemental waste container of claim 11, wherein said supplemental container is formed of a molded plastic.

17. The supplemental waste container of claim 11, wherein the top rim of the supplemental waste container and the first and second members form a plane perpendicular to the side and end walls of the supplemental container.

18. The supplemental waste container of claim 11, wherein the top rim of the supplemental waste container and the first and second members form a plane angled with respect to the side and end walls of the supplemental container.

19. A supplemental waste container for mounting to, and depending from, a top rim of a wastebasket, the wastebasket having parallel side walls and an end wall connecting the side walls, the supplemental container being adapted for mounting to either inside or outside surfaces of the wastebasket along the end wall, said supplemental container comprising:

first and second substantially parallel opposing side walls; first and second substantially parallel opposing end walls connecting the side walls, the side walls having a width substantially equal to an interior width of the end wall of the wastebasket; first and second substantially parallel mounting members extending outwardly from opposite top corners of the first side wall of the supplemental container perpendicular to the first side wall of the supplemental container; said members being parallel to a plane defined by top rims of the side walls and top rims of the ends walls of the supplemental container;

the first side wall being complementarily shaped with an outside surface of the end wall of the wastebasket for juxtaposition therewith when said supplemental container is mounted to said outside of said wastebasket; an out-turned rim being formed along a top edge of the first side wall for mounting over the top rim of the wastebasket along the end wall of the wastebasket; each extending member having depending flanges for mounting over the upper rim of the wastebasket along a first portion of the side walls thereof, said first portion being adjacent to the end wall of the wastebasket;

the second side wall being complementarily shaped with the inside surface of the end wall of the wastebasket for juxtaposition therewith when said supplemental container is mounted to said inside of said wastebasket; an upper outturned rim being formed along a top edge of the second side wall of the supplemental container for mounting over the top rim of the end wall of the wastebasket; the extending members mounting to a second portion of the upper rim of the side walls of the wastebasket, said second portion being offset from the end wall of the wastebasket.

* * * * *

UNITED STATES PATENT AND TRADEMARK OFFICE

CERTIFICATE OF CORRECTION

PATENT NO. : 5,111,951

DATED : May 12, 1992

INVENTOR(S) : John D. Breen, et. al.

It is certified that error appears in the above-indentified patent and that said Letters Patent is hereby corrected as shown below:

IN THE DRAWINGS

Fig. 5, delete reference numerals "30a" and "30b" and insert --32a-- and 32b--, respectively;

delete reference numerals "32b" and "32a" and insert --30b-- and 30a--, respectively;

delete lower reference numeral "26" and insert --28--;

Fig. 6, delete reference numeral "26" and insert --28--;

delete reference numeral "28" and insert --26--;

delete reference numerals "32a" and "32b" and insert ---30a-- and --30b--, respectively;

delete reference numerals "30b" and "30a" and insert --32b-- and 32a--, respectively;

UNITED STATES PATENT AND TRADEMARK OFFICE

CERTIFICATE OF CORRECTION

PATENT NO. :5,11,951
DATED :May 12, 1992
INVENTOR(S) :John D. Breen, et. al.

It is certified that error appears in the above-indentified patent and that said Letters Patent is hereby corrected as shown below:

Col. 4, line 66, delete "3" and insert --4--;

Col. 4, line 7, delete "42" and insert --40--;

line 7, delete "44" and insert --42--.

Signed and Sealed this

Seventeenth Day of August, 1993

Bruce Lehman

*Attest:*

BRUCE LEHMAN

*Attesting Officer*

*Commissioner of Patents and Trademarks*